United States Patent [19]

Byron et al.

[11] Patent Number: 4,668,896

[45] Date of Patent: May 26, 1987

[54] LINEAR GEOMETRY THYRATRON

[75] Inventors: Stanley R. Byron, Seattle, Wash.; Thomas Burkes, Lubbock, Tex.; Rodney A. Petr, Bellevue, Wash.; Israel Smilanski, Beer Shiva, Israel

[73] Assignee: The United States of America as represented by the Secretary of the Air Force, Washington, D.C.

[21] Appl. No.: 708,910

[22] Filed: Mar. 6, 1985

[51] Int. Cl.[4] ..... H01J 17/12

[52] U.S. Cl. ..... 315/330; 313/590; 313/591; 313/592; 313/596; 313/597; 315/334; 315/335

[58] Field of Search ..... 313/590, 591, 592, 595-597, 313/599, 600; 315/326, 330, 334, 335; 333/13, 161

[56] References Cited

U.S. PATENT DOCUMENTS 3,356,893 12/1967 Lafferty ..... 315/111
4,031,424 6/1977 Penfold et al. ..... 313/146
4,356,426 10/1982 Menown ..... 313/193
4,442,383 4/1984 Hill ..... 315/349

*Primary Examiner*—Samuel Scott
*Assistant Examiner*—Allen J. Flanigan
*Attorney, Agent, or Firm*—Bernard E. Franz; Donald J. Singer

[57] ABSTRACT

The low pressure gas-filled thyratron is scalable in the long dimension. Internally the tube is formed as a tetrode, with an auxiliary grid placed between the cathode and the control grid. A DC or pulsed power source drives the auxiliary grid both to insure uniform cathode emission and to provide a grid-cathode plasma prior to commutation. The high voltage holdoff structure consists of the anode, the control grid and its electrostatic shielding baffles, and a main quartz insulator. A small gas flow supply and exhaust system is used that eliminates the need for a hydrogen reservoir and permits other gases, such as helium, to be used. The thyratron provides a low inductance, high current, long lifetime switch configuration; useful for switch-on applications involving large scale lasers and other similar loads that are distributed in a linear geometry.

8 Claims, 10 Drawing Figures

LINEAR GEOMETRY THYRATRON

RIGHTS OF THE GOVERNMENT

The invention described herein may be manufactured and used by or for the Government of the United States for all governmental purposes without the payment of any royalty.

BACKGROUND OF THE INVENTION

The present invention relates generally to the field of thyratrons, and more particularly to thyratrons providing low inductance, high current, long lifetime switches.

Conventional thyratrons supplied commercially for high power switch applications are fabricated in a cylindrical geometry, using sealed-off ceramic/metal tubes. There have been several major obstacles in previous attempts to produce low inductance, high current thyratrons based on commercial thyratron technology. One limitation is associated with the cylindrically symmetrical tube geometry that has been used, which is inherently higher inductance than a linear (stripline) geometry. A closely related limitation is the use of permanent ceramic-to-metal seals in thyratron construction, which successfully permits high temperature bake-out of the tube to yield a long-life, sealed-off structure. However, this type of construction is subject to thermally induced stress, which restricts the maximum scale dimensions of the tube and also prevents the use of an elongated (linear) geometry. Finally, studies of large experimental thyratrons built for low inductance and very high rate of rise of current have shown that the plasma often does not form uniformly within the tube. Instead, small, high current density regions are formed, which produce cathode damage and also result in an inductance that is higher than the value calculated on the basis of a uniform plasma.

U.S. patents showing the state of the art include U.S. Pat. No. 2,813,999 to Foin, Jr., which discloses a high power RF switch tube of rectangular cross section. It comprises a predetermined length of hollow metallic wave guide which includes an anode, cathode, and control grid. U.S. Pat. No. 3,845,427 to Schubert is directed to a thyratron switch in a waveguide. The device of this patent includes a cone such that the overall combination acts as a gas tetrode. A thyratron tetrode is also dislcosed in U.S. Pat. No. 2,953,716. (U.S. Pat. No. 3,084,282) is directed to a thyraton having fast switching characteristics and Krefft (U.S. Pat. No. 3,349,283) relates to a hydrogen filled thyratron capable of operating at very high voltages.

SUMMARY OF THE INVENTION

An object of the invention is to provide a low inductance, high current, long lifetime switch configuration; useful for switch-on applications involving large scale lasers and other similar loads that are distributed in a linear geometry.

The invention relates to a low pressure gas-filled thyratron that is scalable in the long dimension. Internally the tube is formed as a tetrode, with an auxiliary grid placed between the cathode and the control grid. A DC or pulsed power source drives the auxiliary grid both to insure uniform cathode emission and to provide a grid-cathode plasma prior to commutation. The high voltage holdoff structure consists of the anode, the control grid and its electrostatic shielding baffles, and a main quartz insulator. A small gas flow supply and exhaust system is used that eliminates the need for a hydrogen reservoir and permits other gases, such as helium, to be used.

DETAILED DESCRIPTION

The invention described here is a linear geometry thyratron (low-pressure gas-filled switch) that is scalable in the long dimension, producing a low inductance, high current, long lifetime switch. The configuration is useful for switch-on applications involving large scale lasers and other similar loads that are distributed in a linear geometry. This concept is described in a technical report AFWAL-TR-84-2003 titled "Long-Life, High-Current Thyratrons for fast Discharge Lasers" for an Air Force Contract F33615-82-C-2244. A copy of the report is attached hereto as an appendix and is hereby incorporated by reference.

Figure 1:
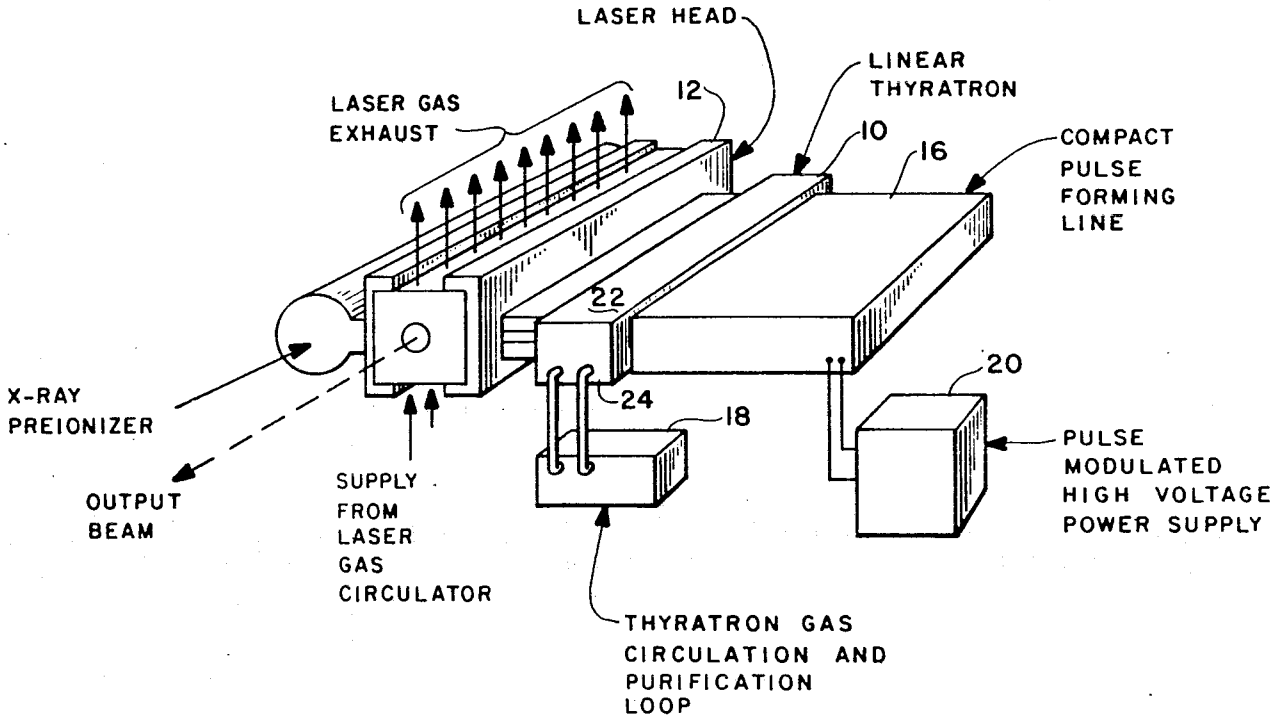
FIG. 1 is a symbolic perspective view of an example of a large-scale discharge laser assembly using a linear thyratron switch according to the invention.

An example application configuration is shown in FIG. 1, which is a symbolic diagram of a large-scale discharge laser assembly using the new linear thyratron switch 10. The thyratron 10 is used as a switch to supply high-voltage energy to a laser head 12 from a compact pulse forming line 16. The pulse forming line 16 is an energy storage device basically comprising two parallel plates separated by a dielectric material. The thyratron is scaled to have a length corresponding to that of the laser head 12 and the pulse forming line 16. The thyratron 10 is provided with a gas circulation and purification loop 18.

The laser head 12 may be coupled to the thyratron 10 and to the pulse forming line 16 by transmission lines in the form of three parallel planes of copper sheet, each having one dimension (transverse to the power flow) approximately equal to the length of the units 10, 12 and 16. One of these copper sheets is fitted tightly to the anode or upper surface 22 of the thyratron 10, connects to one side of the pulse forming line 16, and also to the high voltage side of the power supply 20. Another of the copper sheets is a ground plane fitted tightly to the cathode or lower surface 24 of the thyratron 10, to the laser head 12, and also to the ground side of the power supply 20. The third copper sheet joins the other side of the pulse forming line 16 to the other side of the laser head 12.

The design approach used for the linear geometry thyratron is based on a new structural concept that can be scaled linearly and does not involve oven-fired, sealed-off fabrication methods. High vacuum techniques are used in an O-ring sealed rectangular chamber configuration that provides high gas purity. New (non-ceramic) insulator materials are incorporated that provide high voltage holdoff capability. A small gas flow supply and exhaust system is used that eliminates the need for a hydrogen reservoir and permits other gases, such as helium, to be used. A high current density cathode material is used in a tetrode configuration, which aids in rapid formation of a uniform plasma. The cathode is of the dispenser type, with documented current densities of 80 to 100 A/cm$^2$ and stable operation at room temperature, i.e., with no cathode heater power. Lifetimes of tens of thousands of hours are possible with this cathode. In addition to the design features described above, the first experimental thyratron was designed with optical ports (windows) in the tube walls that permit direct viewing of the cathode-grid space and the anode-gride space. These windows are shown in said report (AFWAL-TR-84-2003), but are omitted herein.

Figure 3:
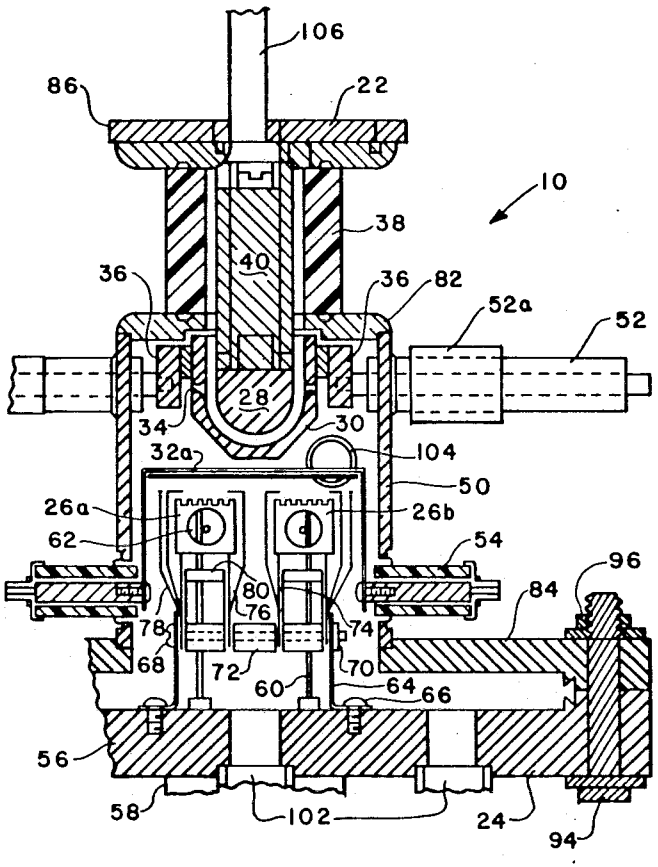
FIGS. 2 and 3 are longitudinal and transverse section views respectively of the linear thyratron design, taken along lines 2—2 and 3—3 of FIG. 5.
Figure 2:
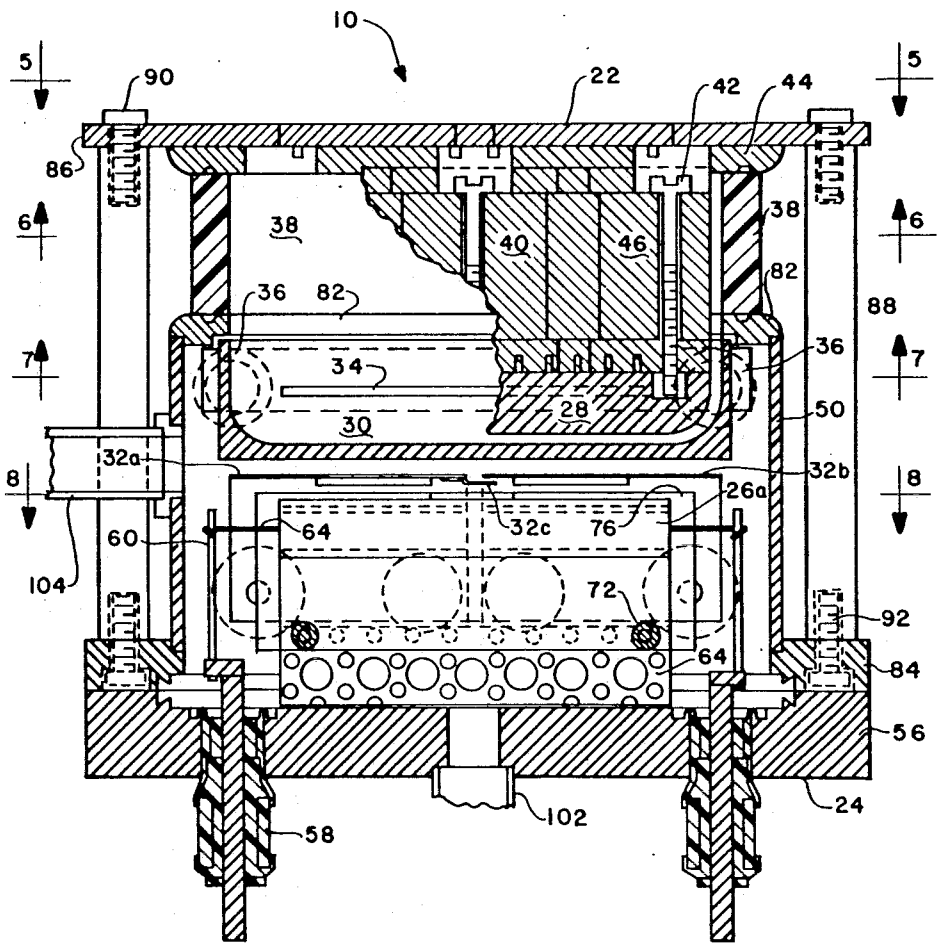
Figure 5:
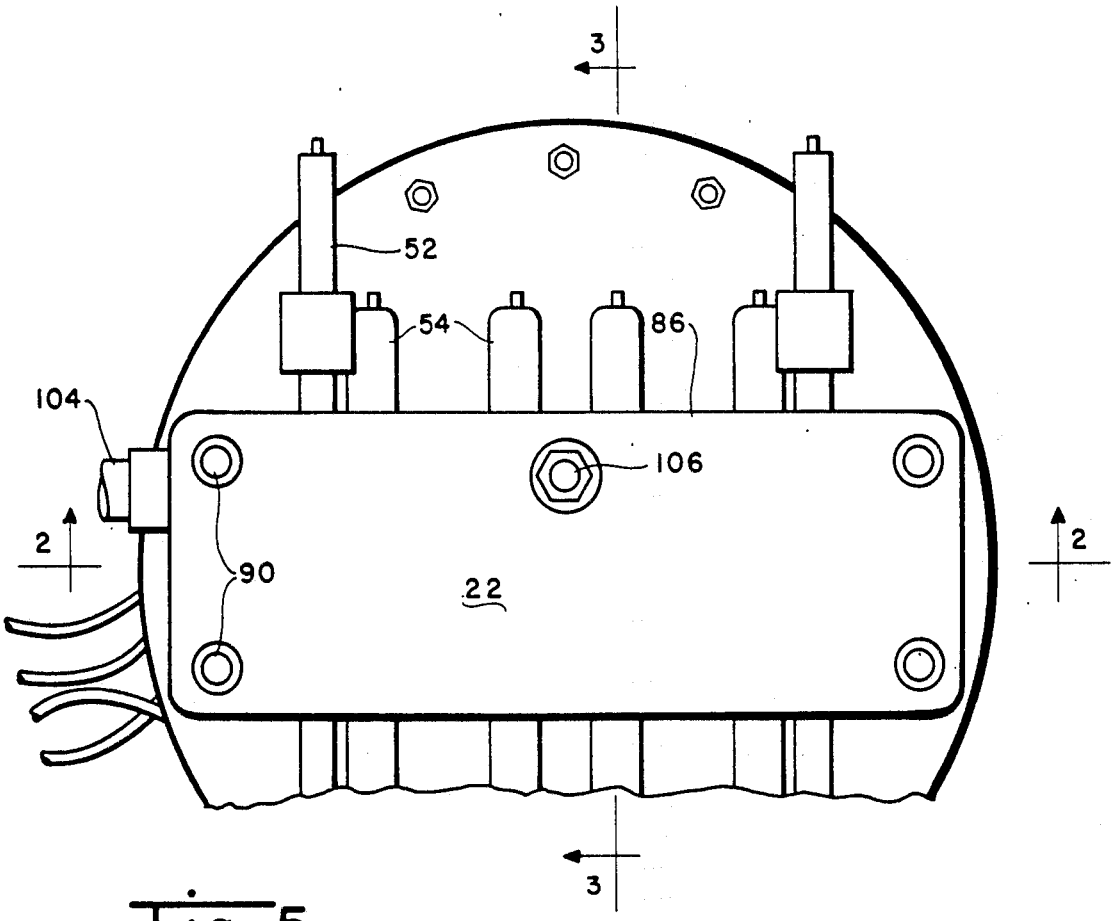
FIGS. 5, 6, 7 and 8 are a top view and three sectional views parallel thereto, taken along lines 5—5, 6—6, 7—7, and 8—8 of FIG. 2.

A 10-cm long linear geometry thyratron 10, fabricted with the design features described above, is shown by a longitudinal sectional view in FIG. 2, taken along lines 2—2 of FIG. 5; and a transverse sectional view in FIG. 3, taken along lines 3—3 of FIG. 5. The tube 10 is a tetrode having a cathode (comprising two sections 26*a* and 26*b*), an anode 28, a control grid 30, and an auxiliary grid 32*a*-32*b* placed between the cathode and the control grid.

The auxiliary grid comprises two metal sheets 32*a* and 32*b* separated by a gap down the center in the transverse direction. One edge 32*c* of sheet 32*a* is bent to extend below the adjacent edge of sheet 32*a* and spaced slightly therefrom to leave an opening. Each sheet 32*a* & 32*b* extends from the center to one end, with a horizontal portion above the cathode, and a vertical portion down along the cathode on each side lengthwise. The auxiliary grid is driven by a dc or pulsed power source both to insure uniform emission and to provide a grid-cathode plasma prior to commutation.

Figure 6:
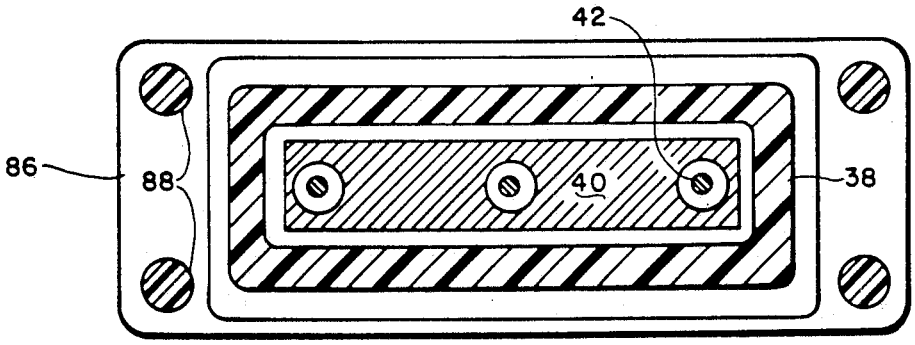
Figure 7:
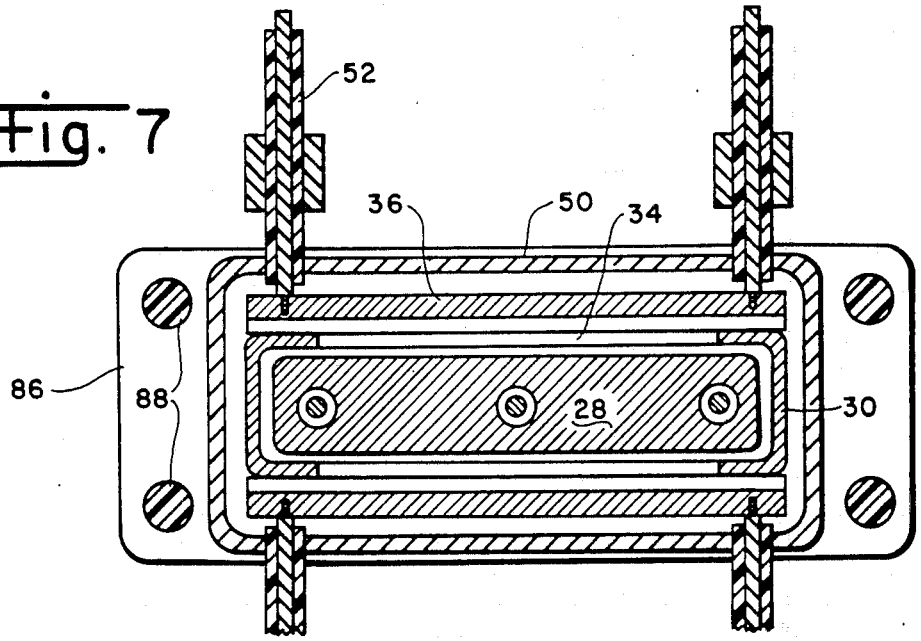

The high voltage holdoff structure consists of the anode 28, the control grid 30 and its electrostatic shielding baffles 36, and a main insulator 38. A horizontal section of the anode and the control grid is shown in FIG. 7, and a horizontal section of the insulator 38 is shown in FIG. 6. The control grid 30 is a cup shaped structure having a rectangular shape in the horizontal section, with the opening of the cup being upward. It has two lengthwise slots 34, one in each of the longer vertical walls. The anode 28 is a solid metal unit having a rectangular shape in the horizontal section, and located inside the cup of the control grid, spaced a short distance therefrom on the bottom and four sides. Note that both the control grid and the anode have a substantial radius at the junction of the sides with the bottom.

The anode and grid structures are derived from the most recent experimental studies of conventional thyratrons. The insulator 38, however, is altered significantly. In present commercially available thyratrons, the alumina insulator and its surface are believed to be a major contributor to the high voltage holdoff limits. With continuous gas pumping and purification, with a lower temperature cathode, and with low thermal dissipation through the walls of the switch, less perfect seals and increased outgassing rates can be tolerated. This frees the design from dependence on alumina as an insulator and structural element. After considering various insulator quality factors, a simple quartz structure was selected because it offers the best combination of mechanical stability and precision, high voltage holdoff, and ease of fabrication. The insulator 38 is formed from a rectangular block of quarts, hollowed through the inside, and forms a wall on the four sides of the tube. See the horizontal section in FIG. 6.

The cathode material is barium aluminate impregnated tungsten, used in a shallow, vane type cathode structure for increased emission area. In spite of its current loading, this cathode, designed specifically for high rate of rise of current and short pulse operation, is much less prone to local thermal runaway and discharge current localization than conventional oxide-coated thyratron cathodes. The dimensions of each section of the cathode structure are 0.6 inches wide by 4 inches long. The exposed emissive surface contains five longitudinal grooves 0.05 inches wide by 0.06 inches deep. The total surface area of the cathode is 30 cm$^2$. Assuming a nominal room temperature emission density of 80 amperes/cm$^2$, the peak current capability of the cathode is 2,400 amperes. This cathode should be capable of 10,000 amperes peak current when heated to a temperature of 1000° C., based on current density versus temperature measurements.

The control grid surrounds the anode with a single grid slot 34 on each side of this re-entrant anode-grid structure. At 5000 amps. peak, the grid slot will operate at a current density approaching 1000 amps./cm$^2$. The length of the control grid is 10 cm, and the dimensions of the thyratron indicate the inductance of the tube to be no more than 10 nH when mounted in a closely fitting metal housing (no viewports). The control grid 30, anode 28, and auxiliary grid 32 are made of stainless steel.

An anode support 40 is attached to the anode 28 by three screws 42, as shown in FIGS. 2, 3 and 6. The support comprises a cover portion 44 and a suspended portion 40 which form a single integral metal part, having three holes for the screws, countersunk at the top for the screw heads. The anode support has two vertical slots milled into it to bring in fresh gas as needed in a flowing gas clean-up system. The cover portion 44 extends over the insulator 38. In FIG. 2, the anode 28 and the anode support 40 are broken away at the left to show the control grid 30 with slot 34. Part of the insulator 38 also appears in elevation in the broken away view.

The thyratron tube has a metal wall 50 surrounding the structure on four vertical sides. As shown in FIGS. 2, 3 and 7, a metal grid baffle 36 surrounds the control grid 30 around its vertical portion, and attached to the grid by a portion above the slots 34. There are four grid support and feedthrough units 52, each having an insulating shell, and a metal feedthrough center. The metal part has a screw point threaded into the grid baffle 36 both for support of the grid structure and for supplying an electrical potential to it. The insulating shell is sealed into the metal wall 50 by conventional brazing.

Figure 4:
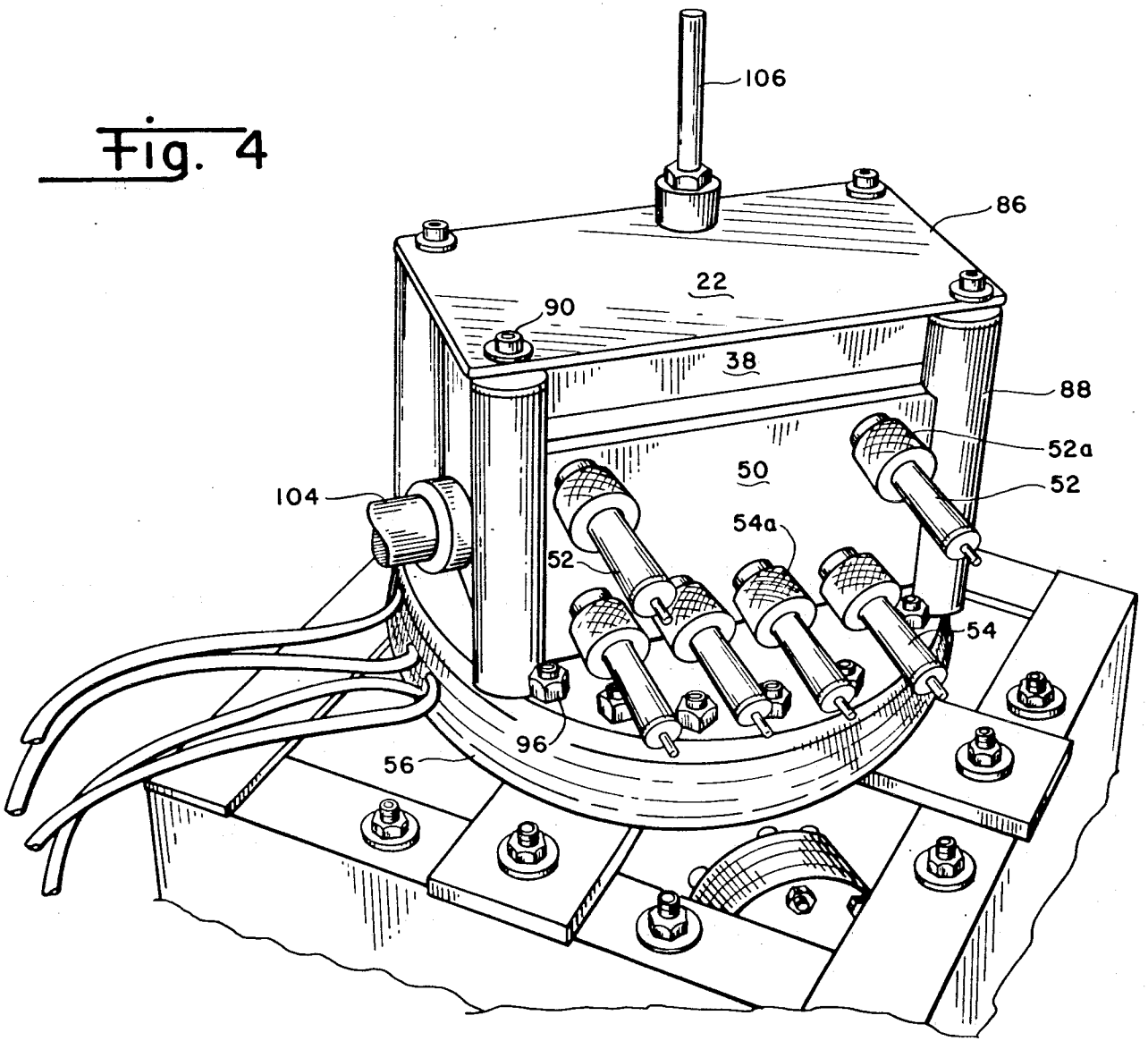
FIG. 4 is a perspective pictorial view of the linear thyratron traced from a photograph of an experimental design.

The parts 52*a* and 54*a* (FIG. 4) are screw theads with O-ring seals to allow flexible locating of the feedthrough parts.

Figure 8:
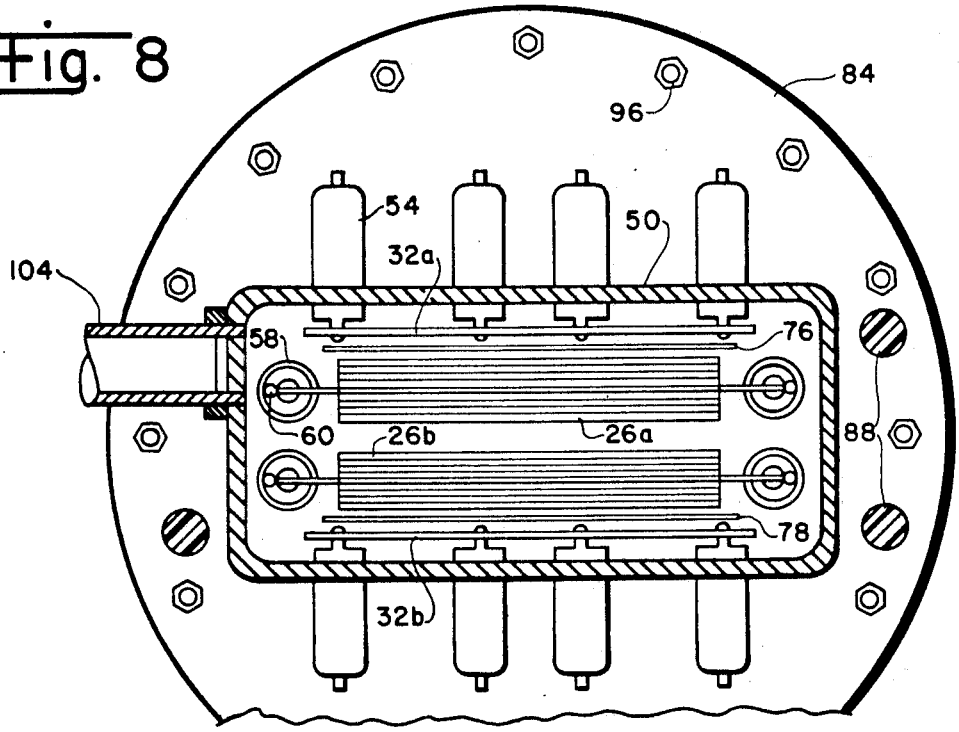

As shown in FIGS. 2, 3 and 8, the auxiliary grid 32*a*-32*b* is supported by eight grid support and feedthrough units 54, each having an insulating shell, and a metal feedthrough center. Each has a screw inserted through a hole of the auxiliary grid and threaded into the metal part of the feedthrough, both for support of the grid structure and for supplying an electrical potential to it. These feedthrough units 54 are also sealed into the metal wall 50 in the same manner as units 52.

A cathode mounting flange 56 is a circular part of metal. There are four heater feedthrough units 58 mounted in the flange 56, each comprising an insulating shell and a metal center. These feedthroughs are sealed into the flange in the same manner as feedthroughs 52 and 54. Each of the heater feedthrough units 58 has a metal post 60 attached to its metal part within the tube. Each of the cathode sections 26*a* & 26*b* has a longitudinal hole 62, with a heater wire 64 extending through it and attached to a post 60 at each end.

The cathode mounting structure includes two vertical metal sheets 64 which are bent at the bottom and attached to the flange 56 by screws 66. These two sheets 64 are perforated with holes of two sizes as shown in FIG. 2, to permit gas flow. Two screws 68 extend through the two sheets 68 and are attached with nuts 70. On each of the screws 68 there are three spacers 72 between the two sheets 64. Each cathode section is supported on two metal sheets 74. The four sheets 74 are mounted on the screws 68, separated by the spacers 72. There are four metal sheets 76 used as cathode shields, one on each side of each cathode section longitudinally. These shields are bent out to be slightly spaced from the cathode sections, and are also bent over at the top for a short distance over the cathode sections. There are two additional sheet metal shields 78 mounted at the ends of the screws 68, at the outer sides of the cathode sections outside of the shields 76. For each pair of the cathode support sheets 74 there are spacers 80 between the two sheets just below the cathode sections.

At the top of the metal wall 50, there is a rectangular metal ring cap 82, which has a lower projection having outside dimensions equal to the inner dimensions of the wall 50, and inner dimensions which extend to below the quartz insulator 38. The upper thicker portion of the cap 82 has outer dimensions equal to the outer dimensions of the wall 50, and inner dimensions equal to the inner dimensions of the insulator 38. The upper outer edge is rounded off with a substantial radius. The flat surfaces of insulator 38 are sealed to anode support 44 and cap 82 by Viton O-rings in grooves in the metal parts.

At the bottom of the metal wall 50, there is a metal ring member 84 which is circular at its outer edge with a diameter equal to that of the cathode mounting flange 56. Its inner edge is rectangular with a thin upper portion having inside dimensions equal to the outside dimensions of the wall 50, an intermediate portion having dimensions equal to the inner dimensions of the wall 50, and a lower circular projection having an inner diameter equal to that of an upward projection of the flange 56. The metal wall 50 is sealed at its top and bottom by brazing. Both the lower projection of ring 84 and the upward projection of flange 56 have a toothed edge around the inner periphery to create a seal on a copper gasket.

There is a rectangular metal clamp plate 86, and four clamp rods 88 which are insulators. The clamp plate extends slightly beyond the anode support 44 in the transverse direction, and somewhat further in the longitudinal direction. Each of the rods 88 is attached to the clamp plate 86 by a screw 90 which passes through a hole of the plate and is threaded into the rod. The rods 88 are attached at their lower ends by screws 92 which pass through holes of the ring 84 and are threaded into the rods. The holes in the ring 84 are countersunk for the heads of the screws 92. The cathode mounting flange 56 is attached to the ring 84 by several screws 94 and nuts 96 around the periphery. The cathode baseplate region is sealed by a copper gasket.

There are a total of five gas ports which are coupled to the gas purification loop 18 shown in FIG. 1, with varian flanges on the ports. Three of the gas ports 102 (FIGS. 2 and 3) extend through the cathode mounting flange 56 and exhaust the gas. One of the ports 104 (FIGS. 2, 3, 4 and 5) extends through the wall 50 and is used to measure pressure. One of the ports 106 (FIGS. 3, 4 and 5) extends through the clamp plate 86 and serves as the gas inlet. There are slots through plate 44 and support 40 to allow gas to flow in.

The experimental prototype of the linear geometry thyratron as shown in said report (AFWAL-TR-84-2003) indicates eight viewing ports for observing the discharge during tube commutation. The viewports are sealed by viton O-rings while the cathode baseplate region is sealed by copper gaskets. The entire structure is demountable.

Figure 9:
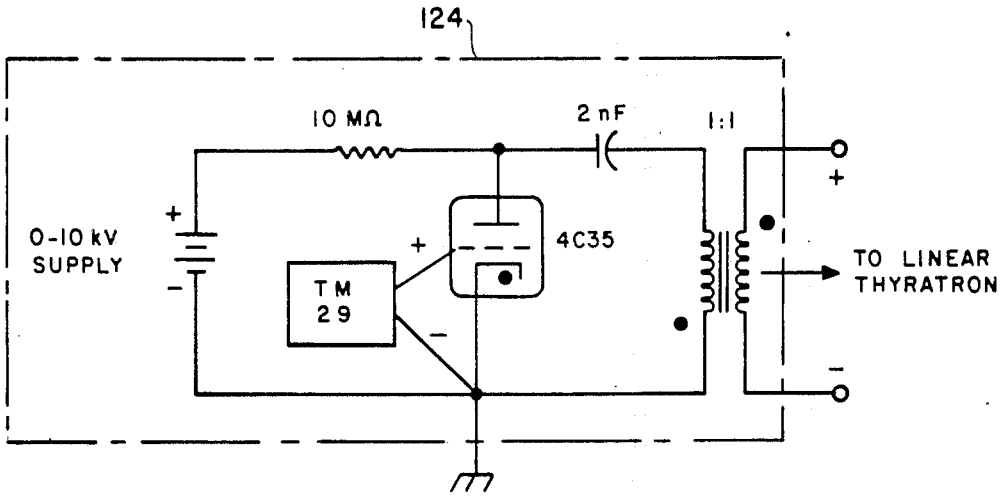
FIG. 9 is a schematic diagram of a control grid drive circuit for the linear thyratron.
Figure 10:
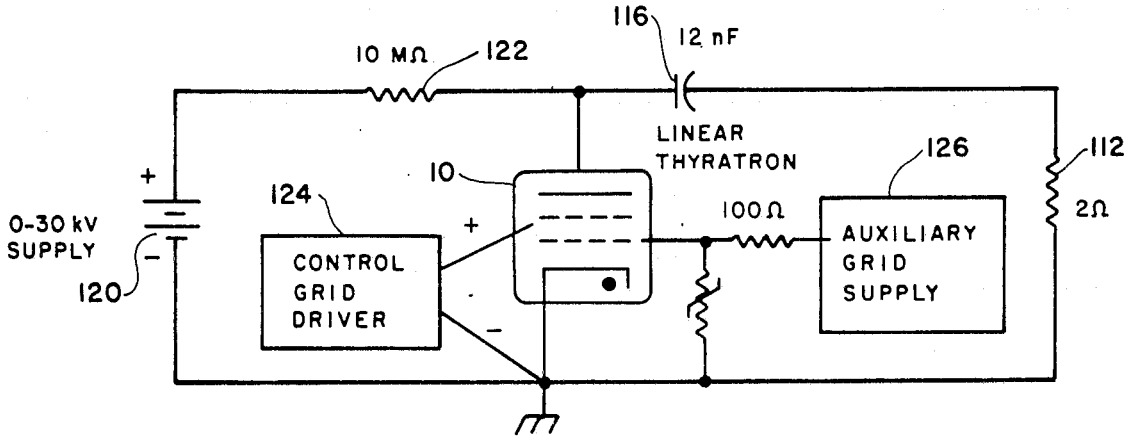
FIG. 10 is a schematic and block diagram of a linear thyratron test circuit.

The liner thyratron 10 was tested electrically using a grid drive circuit 124 shown in FIG. 9 and a high voltage pulse circuit 120 shown in FIG. 10. The power supply includes a series 10-megohm resistor 122, and means not shown to pulse the supply and to vary the output from 0–30 kilovolts. The auxiliary grid was driven by a d.c. supply 126 that delivered a current up to several milliamps. In this initial test circuit, pulse charging of the anode was not used. A 12-nanofarad discharge capacitor 116 was used to simulate the pulse forming line 16, and a 2-ohm resistor 112 was used to simulate the laser head 12, corresponding to an RC decay time of 24 nanoseconds. No attempt was made to build a low-inductance discharge circuit for these initial measurements.

During initial tests, the experimental linear geometry thyratron successfully held off voltage up to 25 kV, the highest that was applied, and successfully switched currents up to 2 kA at a charge voltage of 15 kV and a pulse duration of 100 nsec. The maximum current was limited by the gas (neon) used in the thyratron and by the inductance of the circuit used in the preliminary tests. The discharge plasma, both in the grid-anode and grid-cathode spaces, spread uniformly along the entire length of the tube during commutation. Although this spreading was sensitive to gas pressure and auxiliary grid current, the discharge plasma was uniform even when the thyratron was operated with no external cathode heater power.

The initial tests demonstrate the feasibility of the linear thyratron concept and the soundness of the basic fabrication approach. The results confirm the possibility of developing a new class of closing switches that are linearly scalable to provide low inductance, high standoff voltage, high repetition rate, and be capable of reliable, long lifetime operation.

It is understood that certain modifications to the invention as described may be made, as might occur to one with skill in the field of the invention, within the scope of the appended claims. Therefore, all embodiments contemplated hereunder which achieve the objects of the present invention have not been shown in complete detail. Other embodiments may be developed without departing from the scope of the appended claims. The terms "top" and "bottom" are used with quotation marks to indicate that these terms are used for convenience, and do not indicate a necessary orientation of the thyratron in use.

What is claimed is:

1. A thyratron for use as a high-voltage switch, comprising:

a gas-filled envelope having therein electrodes including cathode means, an anode, a control grid, and an auxiliary grid located between the cathode means and the control grid;

said envelope and each of said electrodes having a rectangular cross section, with the thyratron being linearly scalable for use with stripline geometry in a circuit;

wherein said envelope includes a metal wall around said electrodes on four sides, first cover means of metal for the "top" end, second cover means of metal for the "bottom" end, and a quartz insulator between the metal wall and the first cover means;

anode support means between the anode and the first cover means which mechanically supports the anode and electrically couples it to the first cover means, cathode support means between the cathode and the second cover means which mechanically supports the cathode and electrically couples it to the second cover means;

wherein said control grid is cup shaped open at the top and spaced a short distance from the anode on the four sides and the bottom, the bottom and short sides being solid, with longitudinal slots on the two long sides, grid baffle means comprising two elements of metal extending longitudinally along said slots and beyond the ends of the slots, attached to the control grid above the slots, first feedthrough means extending through and insulated from said metal wall and attached to the baffle means for mechanical support of the baffle and control grid and electrical connection thereto.

2. A thyratron according to claim 1, wherein the material of said cathode means is barium aluminate impregnated tungsten, used in a shallow, vane type cathode structure for increased emission area.

3. A thyratron for use as a high-voltage switch, comprising:

a gas-filled envelope having therein electrodes including cathode means, an anode, a control gird, and an auxiliary grid located between the cathode means and the control grid;

wherein the material of said cathode means is barium aluminate impregnated tungsten, used in a shallow, vane type cathode structure for increased emission area;

said envelope and each of said electrodes having a rectangular cross-section, with the thyratron being linearly scalable for use with stripline geometry in a circuit;

wherein said envelope includes a metal wall around said electrodes on four sides, first cover means of metal for the "top" end, second cover means of metal for the "bottom" end, and a quartz insulator between the metal wall and the first cover means;

including a plurality of gas ports through said envelope for circulation of a selected gas of high purity at low pressure;

anode support means between the anode and the first cover means which mechanically supports the anode and electrically couples it to the first cover means, cathode support means between the cathode and the second cover means which mechanically supports the cathode and electrically couples it to the second cover means;

wherein said control grid is cup shaped open at the top and spaced a short distance from the anode on the four sides and the bottom, the bottom and short sides being solid, with longitudinal slots on the two long sides, grid baffle means comprising two elements of metal extending longitudinally along said slots and beyond the ends of the slots, attached to the control grid above the slots, first feedthrough means extending through and insulated from said metal wall and attached to the baffle means for mechanical support of the baffle and control grid and electrical connection thereto.

4. A thyratron according to claim 3, wherein said auxiliary grid comprises two metal sheets with a gap between them in the transverse direction, with one of the sheets having a lip extending below the other sheet, the sheets being bent at the sides along the length between the cathode means and said metal wall, second feedthrough means extending through and insulated from said metal wall and attached to the auxiliary grid sheets for mechanical support of the auxiliary grid and electrical connection thereto; and wherein said anode, said control grid, and said auxiliary grid are of stainless steel.

5. A thyratron for use as a high-voltage switch in a circuit with a pulse forming line and a laser head in a laser assembly, said tyratron comprising:

a gas-filled envelope having therein electrodes including cathode means, an anode, a control grid, and an auxiliary grid located between the cathode means and the control grid;

said envelope and each of said electrodes having a rectangular cross-section, with the thyratron being linearly scalable for use with stripline geometry in said circuit;

wherein said envelope includes a metal wall around said electrodes on four sides, first cover means of metal for the "top" end, second cover means of metal for the "bottom" end, and a quartz insulator between the metal wall and the first cover means;

anode support means between the anode and the first cover means which mechanically supports the anode and electrically couples it to the first cover means, cathode suppot means between the cathode and the second cover means which mechanically supports the cathode and electrically couples it to the second cover means;

wherein said control grid is cup shaped open at the top and spaced a short distance from the anode on the four sides and the bottom, the bottom and short sides being solid, with longitudinal slots on the two long sides, grid baffle means comprising two elements of metal extending longitudinally along said slots and beyond the ends of the slots, attached to the control grid above the slots, first feedthrough means extending through and insulated from said metal wall and attached to the baffle means for mechanical support of the baffle and control grid and electrical connection thereto;

stripline means comprising a first metal plane fitted tightly to the first cover means, and connected to one side of the pulse forming line, and also to a high voltage source; a second metal plane forming a ground plane fitted tightly to said second cover means, connected to the laser head, and also to ground potential; and a third metal plane joining the pulse forming line to the laser head.

6. A thyratron for use as a high voltage switch, comprising:

a gas-filled envelope having therein electrodes including cathode means, an anode, a control grid, and an auxiliary grid located between the cathode means and the control grid;

said envelope and each of said electrodes having a rectangular cross section, with the thyratron being linearly scalable for use with stripline geometry in a circuit;

wherein said envelope includes a metal wall around said electrodes on four sides, a ring cap on one end of the metal wall extending around the four sides, an insulator formed from a block of quartz, hollowed through the inside, and mounted on the ring cap to form a wall around the four sides, as an extension of said metal wall, so that the envelope has a "top" end with said insulator and a "bottom" end with said metal wall, first cover means of metal for the "top" end, second cover means of metal for the "bottom" end; wherein said control grid is cup shaped open at the top and spaced a short distance from the anode on the four sides and the bottom, the bottom and short sides being solid, with longitudinal slots on the two long sides, grid baffle means comprising two elements of metal extending longitudinally along said slots and beyond the ends of the slots, attached to the control grid above the slots, first feedthrough means extending through and insulated from said metal wall and attached to the baffle means for mechanical support of the baffle and control grid and electrical connection thereto;

a plurality of gas ports through said envelope for circulation of a selected gas of high purity at low pressure;

anode support means between the anode and the first cove means which mechanically supports the anode and electrically couples it to the first cover means, cathode support means between the cathode and the second cover means which mechanically supports the cathode and electrically couples it to the second cover means.

7. A thyratron according to claim 6, wherein the material of said cathode means is barium aluminate impregnated tungsten, used in a shallow, vane type cathode structure for increased emission area;

wherein said ring cap is of metal with a lower projection having outside dimensions equal to the inner dimensions of said metal wall, and which extends into said insulator, with the ring cap having an upper portion which is thicker and has outer dimensions equal to the outer dimensions of the metal wall, the insulator being sealed to the first cover means to the ring cap by O-rings in grooves of the first cover means and the ring cap.

8. A thyratron according to claim 7, wherein said auxiliary grid comprises two metal sheets with a gap between them in the transverse direction, with one of the sheets having a lip extending below the other sheet, the sheets being bent at the sides along the length between the cathode means and said metal wall, second feedthrough means extending through and insulated from said metal wall and attached to the auxiliary grid sheets for mechanical support of the auxiliary grid and electrical connection thereto; and wherein said anode, said control grid, and said auxiliary grid are of stainless steel.

* * * * *